US006731183B2

(12) United States Patent
Watanabe et al.

(10) Patent No.: US 6,731,183 B2
(45) Date of Patent: May 4, 2004

(54) NON-RECIPROCAL CIRCUIT DEVICE AND WIRELESS COMMUNICATIONS EQUIPMENT COMPRISING SAME

(75) Inventors: Shuichi Watanabe, Tottori-ken (JP); Hideto Horiguchi, Tokyo (JP); Yuta Sugiyama, Lajoll, CA (US); Koji Ichikawa, Saitama-ken (JP); Hiroyuki Itoh, Tottori-ken (JP)

(73) Assignee: Hitachi Metals, Ltd., Tokyo (JP)

( * ) Notice: Subject to any disclaimer, the term of this patent is extended or adjusted under 35 U.S.C. 154(b) by 59 days.

(21) Appl. No.: 09/816,115

(22) Filed: Mar. 26, 2001

(65) Prior Publication Data

US 2002/0008596 A1 Jan. 24, 2002

(30) Foreign Application Priority Data

Mar. 27, 2000 (JP) ..... 2000-086166

(51) Int. Cl.[7] ..... H01P 1/32
(52) U.S. Cl. ..... 333/1.1; 333/24.2
(58) Field of Search ..... 333/1.1, 24.2; H01P 1/36, 1/383

(56) References Cited

U.S. PATENT DOCUMENTS 5,774,024 A * 6/1998 Marusawa et al. ..... 333/1.1
5,900,789 A * 5/1999 Yamamoto et al. ..... 333/1.1

FOREIGN PATENT DOCUMENTS

| | | | | |
|---|---|---|---|---|
| EP | 0 664 573 A1 | | 7/1995 | ..... H01P/1/383 |
| EP | 0 843 375 A1 | | 5/1998 | ..... H01P/1/387 |
| JP | 02-300738 A | * | 6/1992 | ..... 333/1.1 |
| JP | 09-055607 | | 2/1997 | ..... H01P/1/383 |
| JP | 11-55009 | | 2/1999 | ..... H01P/1/383 |
| JP | 11-205011 | | 7/1999 | ..... H01P/1/383 |

* cited by examiner

*Primary Examiner*—Robert Pascal
*Assistant Examiner*—Stephen E. Jones
(74) *Attorney, Agent, or Firm*—Finnegan, Henderson, Farabow, Garrett & Dunner L.L.P.

(57) ABSTRACT

A non-reciprocal circuit device comprising a plurality of central conductors 11*a*–11*c* overlapping with electric insulation from each other at 120°, a magnetic body 12 disposed in contact with or close to the central conductors 11*a*–11*c*, matching capacitors, a permanent magnet 3 disposed for applying a DC magnetic field to the central conductors 11*a*–11*c* and the magnetic body 12, and metal cases 1, 2 for receiving these parts and serving as a magnetic yoke, at least the matching capacitors being integrally constituted by a laminate module 5 having a substantially flat lower surface, and the laminate module 5 being disposed on a flat surface of a composite base 6 comprising an insulation member and conductor plates.

14 Claims, 7 Drawing Sheets

NON-RECIPROCAL CIRCUIT DEVICE AND WIRELESS COMMUNICATIONS EQUIPMENT COMPRISING SAME

FIELD OF THE INVENTION

The present invention relates to a non-reciprocal circuit device such as a circulator, an isolator, etc., particularly to a miniaturized, low-loss, highly reliable non-reciprocal circuit device and wireless communications equipment such as a cellular phone comprising such a non-reciprocal circuit device.

BACKGROUND OF THE INVENTION

Non-reciprocal circuit devices such as circulators, isolators, etc. have characteristics of transmitting a signal to only a particular direction while preventing the signal from being transmitted in the opposite direction, and thus are indispensable parts for transmission circuits of microwave transmission equipment for automobile phones, etc. In such applications, the non-reciprocal circuit devices are required to be miniaturized and reduced in loss. A non-reciprocal circuit device, for instance, an isolator, comprises a magnetic body such as a garnet member, etc., three central conductors disposed on the magnetic body such as a garnet member while overlapping at a 120° interval with electric insulation from each other, a permanent magnet for applying a DC magnetic field to the magnetic body, matching capacitors and a metal case serving as a magnetic yoke and containing these parts.

FIG. 15 shows an isolator, one example of the conventional non-reciprocal circuit devices, disclosed in Japanese Patent Laid-Open No. 11-205011. This isolator comprises a box-shaped resin-conductor composite base 96 disposed on a lower case 92, the resin-conductor composite base 96 having recesses 100 for respectively receiving a central conductor assembly 4 comprising three central conductors 11*a*–11*c* disposed on a garnet member 12 with electric insulation from each other, matching capacitors constituted by three flat capacitors 94*a*–94*c*, and a chip resistor 95. Each recess 100 of the resin-conductor composite base 96 is defined by an insulating thermoplastic resin partition 101 for positioning each part. Formed at the bottom of the recess 100 is a ground electrode 102 (indicated by hatching) for connecting the central conductor assembly 4 and the capacitors 94*a*–94*c* to a ground. Each central conductor 11*a*–11*c* has one end connected to an electrode of each capacitor 94*a*–94*c* and the other end connected to a ground electrode 102 on the resin-conductor composite base 96. Each flat capacitor 94*a*–94*c* has two opposing electrodes, one connected to each central conductor 11*a*–11*c*, and the other connected to the ground conductor 102. A resistor 95 is connected to the flat capacitor 94*c* in parallel. A permanent magnet 93 for applying a DC magnetic field to the central conductor assembly 4 is disposed in an upper case 91, which is combined with the lower case 92 to constitute an isolator.

Each of the upper case 91 and the lower case 92 is formed by an iron-based magnetic sheet such as SPCC (cold-rolled steel sheet) plated with silver for functioning as a magnetic yoke constituting a magnetic circuit for applying a magnetic force of the permanent magnet 93 to the central conductor assembly 4. A conductor plate constituting the ground electrode 102 in the resin-conductor composite base 96 is bent to integrally have ground terminals 97*b*, 97*c* exposing from the lower and side surfaces of the resin-conductor composite base, exposed portions of the conductor plate being plated with silver. The resin-conductor composite base 96 is provided on a lower surface with an input/output terminal 97*a* and ground terminals 97*b*, 97*c*. Though not shown, the opposite surface of the resin-conductor composite base is also provided with an input/output terminal 97*a* and ground terminals 97*b*, 97*c*. Accordingly, each of the two central conductors 11*a*, 11*b* has one end connected to the input/output terminal 97*a* via the flat capacitor 94*a*, 94*b*, and the other end connected to the ground terminal 97*b*, 97*c* via the ground electrode 102. The remaining one central conductor 11*c* is connected to the ground terminal 102 for termination via the capacitor 94*c* and the resistor 95.

FIG. 16 shows an isolator, another example of the conventional non-reciprocal circuit devices, disclosed in Japanese Patent Laid-Open No. 9-55607. This isolator has matching capacitors formed inside a laminate module 105 disposed on a lower case 92, and the laminate module 105 having a center opening 110 for receiving a garnet member 12 and a central conductor assembly 4 constituted by three central conductors 11*a*–11*c*, one end of each of three central conductors 11*a*–11*c* being connected to a capacitor 106*a*–106*c* printed on an upper surface of the laminate module 105. A capacitor 106*c* connected to one central conductor 11*c* is electrically connected to a resistor 107 in parallel. The other ends of three central conductors 11*a*–11*c* are directly connected to the lower case 92 without using a ground plate. A permanent magnet 93 for applying a DC magnetic field to the central conductor assembly 4 is disposed in the upper case 91, which is assembled to the lower case 92 to constitute an isolator.

Formed in the laminate module 105 are three matching capacitors in single or multi-layers, and electrodes of the matching capacitors are connected to each other through via-electrodes in the laminate module 105, or external terminals of an input/output terminal 108*a* and ground terminals 108*b*, 108*c* printed on side surfaces of the laminate module 105 as in this example. The laminate module 105 has projections 112 on both sides of a lower surface thereof, onto which an input/output terminal and ground terminals (not shown) are mounted, and a recess 114 between the two projections 112 is formed with an electrode (not shown) for connecting to the lower case, whereby the ground terminals are connected to the lower case-connecting electrodes. The other ends of the central conductors 11*a*–11*c*, namely the side of the central conductors 11*a*–11*c* connected to the lower case 92, are connected to a ground in a circuit board via the lower case 92 and the lower case-connecting electrode and the ground terminals 108*b*, 108*c* of the laminate module 105.

The market of microwave communications equipments such as cellular phones, etc. has dramatically been expanding recently, accompanied by the rapid miniaturization of cellular phones. Arising with the miniaturization of cellular phones is a strong demand to miniaturization of such parts as isolators, etc., and particularly the isolators are most strongly demanded to be small in size and low in loss. If the conventional isolator disclosed in Japanese Patent Laid-Open No. 11-205011 were to be miniaturized, then parts such as a garnet member 12, flat capacitors 94*a*–94*c*, etc. would have to be miniaturized. The capacitance of a capacitor is expressed by $$C=\epsilon_r\cdot\epsilon_o\cdot S/d \quad (1)$$

wherein C is a capacitance of a capacitor, $\epsilon_r$ is a specific dielectric constant of a dielectric body, $\epsilon_o$ is a dielectric constant of vacuum, S is an area of an electrode, and d is a thickness of a dielectric body between the electrodes.

The formula (1) indicates that to keep the same level of capacitance even when the electrode area S is reduced by the miniaturization of the matching capacitor, it is necessary to use a dielectric body with a large specific dielectric constant $\epsilon_r$ or to reduce the thickness d of a dielectric body between the electrodes. However, dielectric bodies having large specific dielectric constants generally tend to have large dielectric loss, resulting in the loss characteristics of capacitors and thus increase in the loss of isolators.

When a dielectric body disposed between the electrodes has a small thickness, its handling is difficult during the production process, resulting in cracking and breakage of capacitors, leading to a poor yield. When a garnet member has a small diameter, a central conductor assembly comprising the central conductors and the garnet member has a small inductance, necessitating the capacitors to have larger capacitance to operate at the same operation frequency, causing the same problems as the miniaturization of the capacitors. Though the garnet member having a larger thickness can increase the inductance of the central conductor assembly, it undesirably hinders the reduction of the thickness of an isolator. Further, the miniaturization of parts such as the capacitors and the garnet member results in the complicated structure of a box-shaped resin-conductor composite base, making it difficult to produce the resin-conductor composite base.

Because the isolator of Japanese Patent Laid-Open No. 9-55607 has a structure in which matching capacitors are formed inside the laminate module 105, it is considered that capacitance can easily be obtained by forming capacitors in a plurality of layers of the laminate module. The miniaturization of the laminate module is expected, because the above structure makes it easy to reduce an electrode area of a capacitor without reducing capacitance.

However, because the above isolator uses a laminate module 105 having an opening 110, the other ends of the central conductors 11*a*–11*c* are directly soldered to the lower case 92, and lower case-connecting electrodes (not shown) in the recess 114 on the lower surface of the laminate module 105 are soldered to the lower case 92. Because the lower case-connecting electrodes on the lower surface of the laminate module 105 are connected to ground terminals 108*b*, 108*c*, the other ends of the central conductors 11*a*–11*c* are grounded via the lower case 92 and lower case-connecting electrodes on the lower surface of the laminate module 105.

It is generally important that parts operable in a microwave frequency region such as isolators, etc. have internal circuits grounded without loss. In the case of the isolator, it is necessary that there is as little loss as possible in the lower case 92 and lower case-connecting electrodes on the lower surface of the laminate module 105 to ground the central conductor assembly 4 without loss. To suppress loss during the transmission of a high-frequency signal, the case is made of highly conductive materials such as silver, copper, etc., or it is provided with as thick plating or electrode as 30 $\mu$m or more to reduce electric resistance. However, the lower case 92 is made of an iron-based metal, because it constitutes a magnetic yoke, thereby having a relatively low electric conductivity. Also, with as thick silver plating as 30 $\mu$m or more, the case is as expensive as two times or more than otherwise.

Further, too thick plating tends to cause cracking in the plating layer due to internal stress, resulting in the deterioration of reliability. For instance, if gold is used instead of silver, gold forms a gold-rich alloy with solder components in a lead-tin solder, resulting in the formation of a mechanically brittle intermetallic compound, which leads to poor reliability. These problems indicate that it is difficult to obtain low-loss isolators with the structure of directly soldering central conductors to a lower case.

With respect to the lower case-connecting electrodes formed in a recess 114 on the lower surface of the laminate module 105, deformation is likely to occur in the laminate module with a large electrode thickness during the sintering process, due to the differences in a thermal expansion coefficient, a sintering shrinkage ratio, a sintering shrinkage speed, etc. between the dielectric materials such as ceramics and the electrode materials such as silver. Accordingly, the electrode cannot be made fully thick, resulting in poor electric conductivity in the lower case-connecting electrodes directly formed on the laminate module 105, making it difficult to ground the central conductors without loss. Thus, large loss cannot be avoided in the above isolator.

In the above isolator, external terminals 108*a*–108*c* are integrally formed on the bottom or side surfaces of the laminate module 105 for connection to a circuit board. It is considered that the laminate module 105 provided with external terminals is superior to a resin-conductor composite base provided with external terminals like the isolator as shown in FIG. 15, because of a smaller number of parts. However, when connection is kept between the external terminals formed on the laminate module 105 and an external circuit, stress would be concentrated on the external terminals of the isolator, if the parts-mounting circuit board forming the external circuit is deformed for some reasons, for instance, by dropping a mobile terminal, etc. Therefore, the laminate module 105 is easily broken, resulting in breakage of the isolator. Particularly when there is uneven surface flatness in the external terminals, they cannot be precisely positioned on a test plate for measurement of their characteristics, resulting in uneven measurement results. Thus, direct mounting of the external terminals to the laminate module tends to lower the reliability of the isolator.

Further in the above isolator, ridges 112 should be provided on both side ends on the lower surface of the laminate module 105 to provide the laminate module 105 with external terminals 108*a*–108*c*. In the production process of the laminate module 105, such integral steps make it impossible to press green sheets uniformly in a plane, leaving difference in density between the ridges and the recesses. This difference in press density leads to difference in a sintering shrinkage ratio between the ridges and the recesses, resulting in a deformed laminate module 105 after sintering. If the laminate module 105 is deformed, the external terminals have poor flatness, resulting in poor connection to the external circuit on the circuit board. Though a vertical load may be applied to the laminate module during sintering to suppress its deformation in a plane, this makes the sintering process complicated, undesirably increasing production cost.

OBJECT OF THE INVENTION

Accordingly, an object of the present invention is to provide a miniaturized, low-loss, high-reliability, easy-to-produce non-reciprocal circuit device, and a wireless communications equipment comprising such a non-reciprocal circuit device.

SUMMARY OF THE INVENTION

The non-reciprocal circuit device of the present invention comprises a plurality of central conductors overlapping with electric insulation from each other at a predetermined angle, a magnetic body disposed in contact with or close to the central conductors, matching capacitors, a permanent magnet disposed for applying a DC magnetic field to the central conductors and the magnetic body, and metal cases for receiving these parts and serving as a magnetic yoke, at least the matching capacitors being integrally constituted in a laminate module having a substantially flat lower surface, and the laminate module being disposed on a substantially flat surface of a composite base comprising an insulation member and conductor plates.

Because the matching capacitors are formed in the laminate module in single or plural layers, the number of layers may be properly set to obtain the desired capacitance. Therefore, the capacitance of capacitors can be increased without increasing an electrode area. Because a reduced electrode area can be achieved with the same capacitance, the laminate module constituting capacitors can be miniaturized, resulting in miniaturization of an isolator. Further, by selecting materials having a small dielectric constant for the laminate module, the capacitors can be provided with reduced dielectric loss, thereby improving the loss characteristics of the isolator.

The laminate module having a flat lower surface is directly disposed on a flat upper surface of the composite base, a wide contact area can be obtained between both ground electrodes. Also, the composite base is disposed on the lower case, and the laminate module is disposed thereon, resulting in easiness in assembling of parts.

In a preferred embodiment, the composite base comprises a ground electrode connected to the central conductors and the capacitors of the laminate module and terminal electrodes connected to the central conductors and the capacitors of the laminate module on the same plane, the ground terminals connected to the ground electrode and the input/output terminals connected to the terminal electrodes being provided as external terminals on side surfaces and/or a lower surface of the laminate module. The laminate module has a ground electrode for connecting the capacitors to a ground on a substantially entire lower surface thereof, the ground electrode of the laminate module being disposed directly on a substantially entire upper surface of a ground electrode of the composite base and electrically connected thereto, and the ground electrode of the composite base being disposed directly on a lower metal case and electrically connected thereto.

With this structure, the lower surface of the laminate module is in close contact with the ground electrode (conductor plate) of the composite base and directly soldered to each other. The ground electrode (conductor plate) on a lower surface of the composite base is in close contact with the upper surface of the lower base and directly soldered to each other. Because this provides a wide contact area, the insertion loss is decreased, thereby providing good connection of the ground electrode and the terminal electrodes without loss. Further, it provides good characteristics of attenuating second and third harmonic, and improved mechanical strength. Thus, the close contact of the laminate module and the resin-conductor composite base to the lower case without gap is an important feature of the present invention.

With respect to external terminals such as the ground terminals connected to the ground electrode and the input/output terminals connected to the terminal electrodes, they are integrally formed on side surfaces and/or a lower surface of the composite base with a conductor plate, low loss can be achieved. Also, because the lower surface of the resin-conductor composite base is highly flat, insufficient contact is not likely with a test board or a parts-mounting circuit board, thereby providing a non-reciprocal circuit device with stable characteristics.

The composite base is desirably a resin-conductor composite base comprising conductor plates having an electric resistance of $5.5\times10^{-8}$ Ω·m or less integrally molded with an insulating thermoplastic resin. Though insulating materials forming the laminate module may be synthetic resins and ceramics, insulating thermoplastic resins such as polyethylene, polypropylene, polyethylene terephthalate (PET), etc. are preferable from the aspect of easy of production and impact resistance. Considering strength and heat resistance, it is preferable to use insulating thermoplastic engineering resins such as liquid-crystal, aromatic polymers containing silica fillers, polyphenylene sulfide, etc.

Though the conductor plate may be made of steel such as SPCC, copper, silver and other metals having the same low electric resistance preferable. Specifically, high-conductivity metals having electric resistance of $5.5\times10^{-8}$ Ω·m or less or metals plated with silver or copper are preferable. From the aspect of erosion of a circuit board with solder, a copper plate is preferable. From the aspect of formability, a metal plate of 0.03–0.15 mm in thickness is preferable.

With this structure, the insertion loss greatly lowers, and harmonic characteristics are remarkably improved. When the connection of the internal circuit of an isolator to an external circuit is carried out by the external terminals of the resin-conductor composite base, an external circuit board may be deformed for some external causes, for instance, by dropping of a cellular phone. In such a case, a stress that would otherwise be applied to the laminate module 5 would be absorbed by conductor plates of the external terminals and an insulating thermoplastic resin portion around the conductor plates in the resin-conductor composite base. Accordingly, the breakage of the laminate module and the isolator by stress can be avoided.

The terminal electrodes and at least one input/output terminal are integrally formed by the same conductor plate in the resin-conductor composite base. With this structure, an electric resistance can extremely be reduced between the terminal electrodes and the input/output terminals of the resin-conductor composite base, thereby remarkably suppressing electric loss in the connection of the central conductors and the capacitors to the external circuit.

A ground electrode and at least one ground terminal are preferably integrally formed by the same conductor plate in the resin-conductor composite base. With this structure, an electric resistance between the ground electrode and the ground terminals in the resin-conductor composite base can be made extremely low, thereby remarkably suppressing electric loss in the connection of the central conductors and the capacitors to a ground. This is an important feature of the present invention, because the connection of the internal circuit to a ground without loss is important for the reduction of loss in parts operable in a microwave region such as an isolator, etc.

The ground electrode and the terminal electrodes of the resin-conductor composite base preferably have contact surfaces in the same plane. With this structure, the laminate module has input/output electrodes connected to the terminals of the resin-conductor composite base and a ground electrode connected to the ground electrode of the resin-conductor composite base in the same plane on a surface in contact with the resin-conductor composite base. This makes it unnecessary to provide the laminate module with ridges necessary for the conventional non-reciprocal circuit device shown in FIG. 16, thereby avoiding the deformation of the laminate module without complicated production processes.

The resin-conductor composite base preferably has a means for positioning the laminate module on a flat upper surface thereof. Utilizable as a positioning means is, for instance, external terminals provided on side surfaces of the resin-conductor composite base. This structure facilitates the mounting, positioning and fixing of the laminate module onto a flat surface of the resin-conductor composite base, resulting in the simplification of production processes. Further, because improper positioning of the laminate module relative to the resin-conductor composite base can be suppressed, the production yield of the non-reciprocal circuit device is improved.

The central conductors are preferably formed in an integral central conductor laminate comprising a plurality of ceramic sheets having central conductor patterns. The ceramic sheets are preferably formed of magnetic ceramics such as garnet. This structure makes it possible to form the capacitors and the central conductors into an integral laminate, thereby achieving the miniaturization of the non-reciprocal circuit device, the simplification of its structure, and thus shortening the production processes. Also, to obtain high dimension accuracy and stable electric characteristics, it is effective to use a central conductor assembly comprising central conductors formed from a copper plate by etching, which are wound around a microwave magnetic, sintered ferrite member at a predetermined angle.

The electrode patterns in the laminate module are preferably connected through via-electrodes and/or side-surface electrodes. Also, the electrode patterns in the central conductor laminate are preferably connected through via-electrodes and/or side-surface electrodes. With via-electrodes, the number of production can be reduced to lower the production cost of the non-reciprocal circuit device, though they are slightly disadvantageous in miniaturization. In the case of using electrodes printed on side surfaces, the non-reciprocal circuit device can be further miniaturized. Using both via-electrodes and electrodes printed on side surfaces, the resistance of conductors can be suppressed while compensating defects of both electrodes, thereby achieving low loss.

The central conductors are preferably bent along an outer surface of the magnetic body, and insulation films are disposed between the central conductors in their crossing portions. The central conductors and the magnetic body are formed by an integral laminate comprising a plurality of ceramic sheets having central conductor patterns.

In the preferred embodiment, at least a lower case of the metal cases is formed by an integral laminate of a metal having as high saturation magnetic flux density as 0.6 T or more clad with a high-conductivity metal having an electric resistance of $5.5=10^{-8}$ Ω·m or less, whereby the lower case serves as an electrically conductive magnetic yoke.

The wireless communications equipment of the present invention comprises the above non-reciprocal circuit device, a transmission circuit, a reception circuit, and an antenna. The wireless communications equipment is preferably a cellular phone.

BRIEF DESCRIPTION OF THE DRAWINGS

FIG. 11(*b*) is a partially cross-sectional side view showing a connecting portion of the resin-conductor composite base and the laminate module;

BEST MODE FOR CARRYING OUT THE INVENTION

Figure 1:
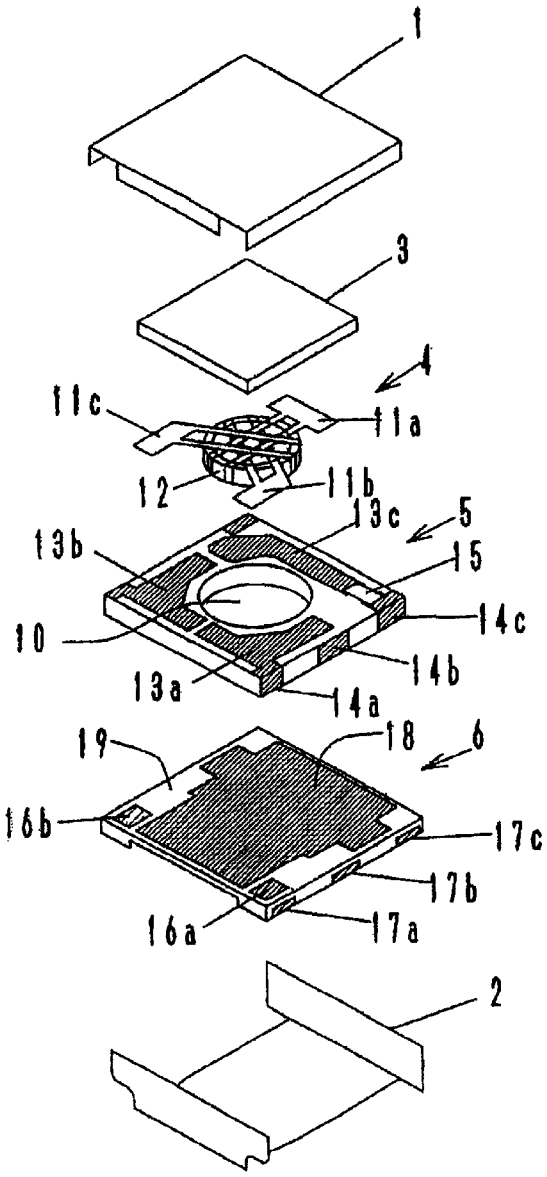
FIG. 1 is an exploded perspective view showing a non-reciprocal circuit device according to the first embodiment of the present invention.

The present invention is characterized in that a miniaturized, low-loss, high-reliability non-reciprocal circuit device is obtained by constituting at least matching capacitors in a laminate module, electrically conducting an internal circuit of the laminate module to an external circuit of a parts-mounting circuit board via external terminals mounted onto a composite base (resin-conductor composite base), and by connecting the laminate module to the resin-conductor composite base and the lower case by placing them in a plane. The laminate module is obtained by printing electrodes on ceramic green sheets, laminating and pressing the green sheets, and then sintering them, like laminate chips. The internal electrodes of the laminate module are formed at the same time as sintering the ceramic. Electrodes on the side surfaces of the laminate module may be formed by sintering together with the ceramic, or by printing an electrode material on the sintered ceramic green sheets, and laminating and burning them.

Specific examples of the present invention will be described below in detail referring to the drawings attached hereto. In examples of the present invention, the non-reciprocal circuit device is exemplified by an isolator, though it is not restricted to an isolator, because a circulator can be constituted when one capacitor is not terminated by a resistor.

[1] Non-reciprocal circuit device (1) First Embodiment

FIG. 1 is an exploded perspective view showing an isolator according to the first embodiment of the present invention. This isolator comprises a laminate module 5 and a central conductor assembly 4 disposed on a resin-conductor composite base 6, a permanent magnet 3 disposed thereon for applying a DC magnetic field to the central conductor assembly 4, and metal cases 1, 2 serving as a magnetic yoke and enclosing these parts vertically. The central conductor assembly 4 may basically have the same structure as that of the above-described conventional one. A disc-shaped magnetic body made of garnet, etc. is disposed on a central, circular ground conductor having three conductors radially extending therefrom, the three extending conductors being bent and overlap via insulating films for insulation from each other at an interval of 120°, thereby constituting the central conductor assembly 4. The central conductor assembly 4 is inserted into a center bore 10 of the laminate module 5, with one end of each central conductor 11*a*–11*c* connected to an electrode 13*a*–13*c* of each capacitor on an upper surface of the laminate module 5, and with the other end of each central conductor 11*a*–11*c* connected to a ground electrode (conductor plate) 18 of the resin-conductor composite base 6 via a ground conductor positioning on a lower surface of the garnet member 12.

Figure 2:
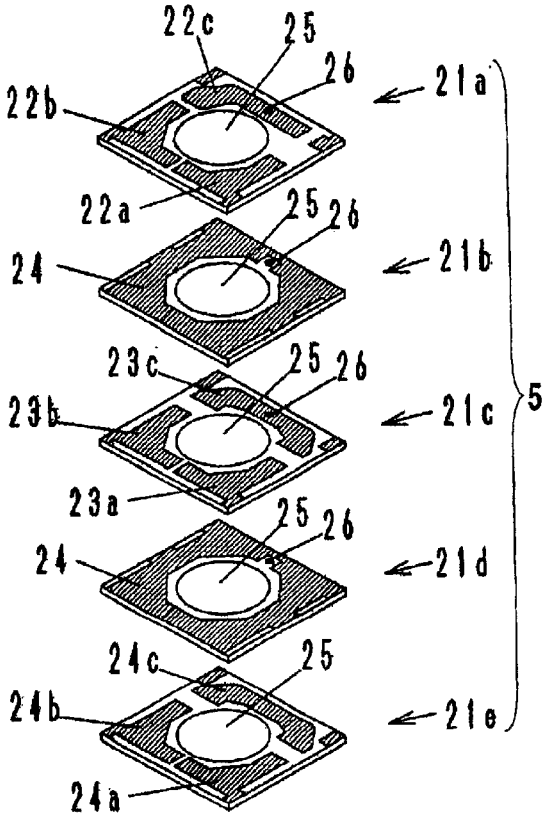
FIG. 2 is an exploded perspective view showing the structure of a laminate module according to the first embodiment of the present invention.

As shown in FIG. 2, the laminate module 5 is constituted by laminating dielectric ceramic green sheets 21*a*–21*e* printed with electrode patterns 22*a*–22*c*, 23*a*–23*c* and 24*a*–24*c* for forming capacitors and a ground electrode 24, the electrode patterns 22*a*, 23*a*, 24*a* forming an input-side capacitor, the electrode patterns 22*b*, 23*b*, 24*b* forming an output-side capacitor, and the electrode patterns 22*c*, 23*c*, 24*c* forming a load-side capacitor. These green sheets 21*a*–21*e* are laminated, pressed and then sintered to form each capacitor. Electrodes inside the laminate module 5 are formed at the same time as sintering a ceramic. In this laminate module 5, the load electrodes 22*c*, 23*c*, 24*c* are connected through a via-electrode 26. The connection of electrodes existing on different layers are achieved with side-surface electrodes formed by printing an electrode material on side surfaces of the laminate module 5 after sintering and burning it, like a side-surface electrode 14*a* for connecting the electrodes 22*a*, 23*a*, 24*a*. The electrodes 22*a*, 23*a*, 24*a* and 22*b*, 23*b*, 24*b* for capacitors may be connected through via-electrodes. The ground electrodes 14*b*, 14*c* are also formed as side-surface electrodes. The bore 10 may be provided substantially at a center of the laminate module 5 by laminating green sheets 21*a*–21*e* each having a bore 25, though the bore 10 is preferably provided in a laminate block obtained by laminating and pressing the green sheets.

Figure 3:
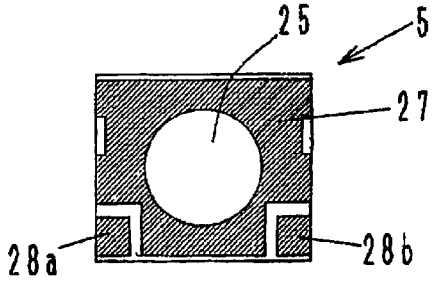
FIG. 3 is a bottom view showing the laminate module of FIG. 2.

A resistor 15 is formed on the upper surface of the laminate module 5 by printing and burning. A chip resistor may be used in place of the printed resistor, and a resistor may be formed by simultaneous burning with the ceramic. Also, as shown in FIG. 3, input/output electrodes 28*a*, 28*b* connectable to terminal electrodes 16*a*, 16*b* (separate conductor plates) of the resin-conductor composite base 6 are formed at corners on a lower surface of the laminate module 5, namely a surface of the laminate module 5, which is to be in contact with the ground electrode 18 (conductor plate) of the resin-conductor composite base 6. A ground electrode 27, which is to be in contact with the ground electrode 18 of the resin-conductor composite base 6, is formed on an entire lower surface of the laminate module 5 except for exposed portions surrounding the input/output electrodes 28*a*, 28*b*. This ground electrode 27 is adapted to be brought into contact with substantially the entire flat, upper surface of the ground electrode 18 (conductor plate) of the resin-conductor composite base 6, and a substantially entire lower surface of the ground electrode 18 is adapted to be in contact with a lower metal case 2. Thereafter, a contact portion is electrically connected by solder reflow.

Figure 4:
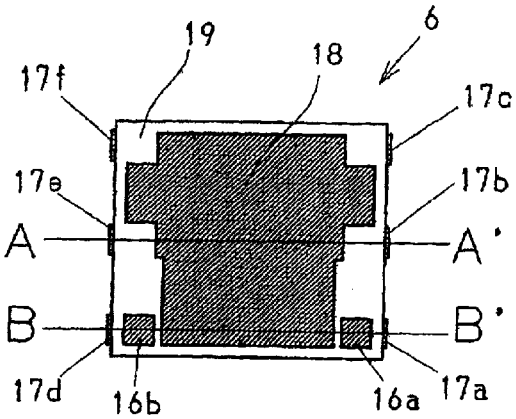
FIG. 4 is a plan view showing a resin-conductor composite base according to the present invention.
Figure 5:
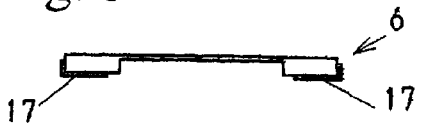
FIG. 5 is a side view showing a resin-conductor composite base of FIG. 4.
Figure 6:
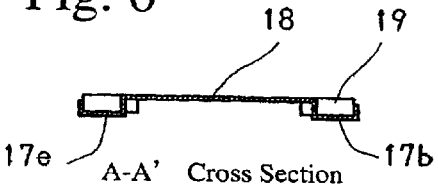
FIG. 6 is a cross-sectional view taken along the line A–A' in FIG. 4.
Figure 7:
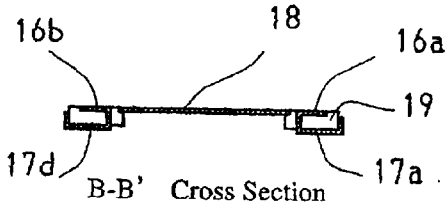
FIG. 7 is a cross-sectional view taken along the line B–B' in FIG. 4.

FIGS. 4 and 5 are respectively a plan view and a side view of the resin-conductor composite base 6, FIG. 6 is a cross-sectional view taken along the line A–A' in FIG. 4, and FIG. 7 is a cross-sectional view taken along the line B–B' in FIG. 4. In FIGS. 4–7, hatched portions are conductor plates, and white portions are insulating thermoplastic resin portions. As shown in FIG. 5, an upper surface of the resin-conductor composite base 6, which is brought into contact with the lower surface of the laminate module 5, is in a flat plane including the ground electrode 18 (conductor plate) and an insulating thermoplastic resin portion 19. The ground electrode 18 and ground terminals 17*b*, 17*c*, 17*e*, 17*f* are integrally constituted by a single conductor plate I. The ground electrode 18 and the terminal electrodes 16*a*, 16*b* are formed on the same flat plane. Also, a terminal electrode 16*a* on the input side and an input external terminal 17*a* are integrally constituted by another single conductor plate II. A terminal electrode 16*b* on the output side and an output external terminal 17*d* are integrally constituted by a still further single conductor plate III. The conductor plates I, II, III constitute the same flat plane.

Each conductor plate I, II, III may be a 0.1-mm-thick copper plate, for instance, and integrally molded into the resin-conductor composite base 6 by an insert molding method using a liquid-crystal, aromatic polymer ("Sumika Super," available from Sumitomo Chemical Co., Ltd.). A copper plate is preferable, because it is excellent in workability and insertion loss-decreasing effects, free from problems such as erosion with solder.

Because the ground electrode 18 and the ground terminals 17*b*, 17*c*, 17*e*, 17*f* are constituted by the same conductor plate in the resin-conductor composite base 6, there is extremely small electric resistance between the ground electrode 18 and the ground terminals 17*b*, 17*c*, 17*e*, 17*f*. Therefore, the ground electrode 27 of the laminate module 5 is grounded with small loss. Also, because the terminal electrode 16*a* and the input/output terminal 17*a* are constituted by the same conductor plate, there is extremely small electric resistance between the terminal electrode 16*a* and the input/output terminal 17*a*. Further, because the terminal electrode 16*b* and the input/output terminal 17*d* are constituted by the same conductor plate, there is extremely small electric resistance between the terminal electrode 16*b* and the input/output terminal 17*d*. Accordingly, the input/output electrodes 28*a*, 28*b* of the laminate module 5 are connected to the input and output circuits with small loss.

The external terminals 17*a*–17*f* (input/output terminals and ground electrode) formed on the resin-conductor composite base 6 are connected to an external circuit. Because of this structure, even when an external circuit board, onto which the laminate module 5 is mounted, is deformed for some external causes, a stress that would otherwise be applied to the laminate module 5 would be absorbed by conductor plates of the external terminals 17*a*–17*f* and an insulating thermoplastic resin portion around the conductor plates in the resin-conductor composite base 6. Accordingly, strong connection is kept between the external circuit and the isolator, which is less likely to be damaged. Further, because the external terminals provided on a lower surface of the resin-conductor composite base 6 are flat, insufficient contact is not likely between the external terminals and the laminate module-mounting circuit board.

Figure 8:
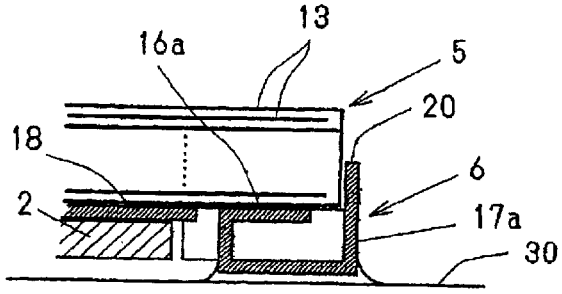
FIG. 8 is an enlarged view showing a connecting portion of the resin-conductor composite base according to the first embodiment of the present invention and an external circuit.

Because the laminate module 5 and the central conductor assembly 4 are mounted successively onto the resin-conductor composite base 6, their assembling is easy. Further, because the resin-conductor composite base 6 and the laminate module 5 are both in a rectangular shape having substantially the same size, high accuracy can be achieved in assembling. As shown in FIG. 8, a projection 20 extending from the external terminal 17*a* can serve as a positioning means for the laminate module 5 on a surface of the resin-conductor composite base 6, which is brought into contact with the laminate module 5, thereby facilitating the assembling. A plurality of such structures may be provided in other portions. Thus, a miniaturized, low-loss isolator having an outer size of 4 mm×4 mm×1.7 mm, for instance, can be obtained.

(2) Second Embodiment

Figure 9:
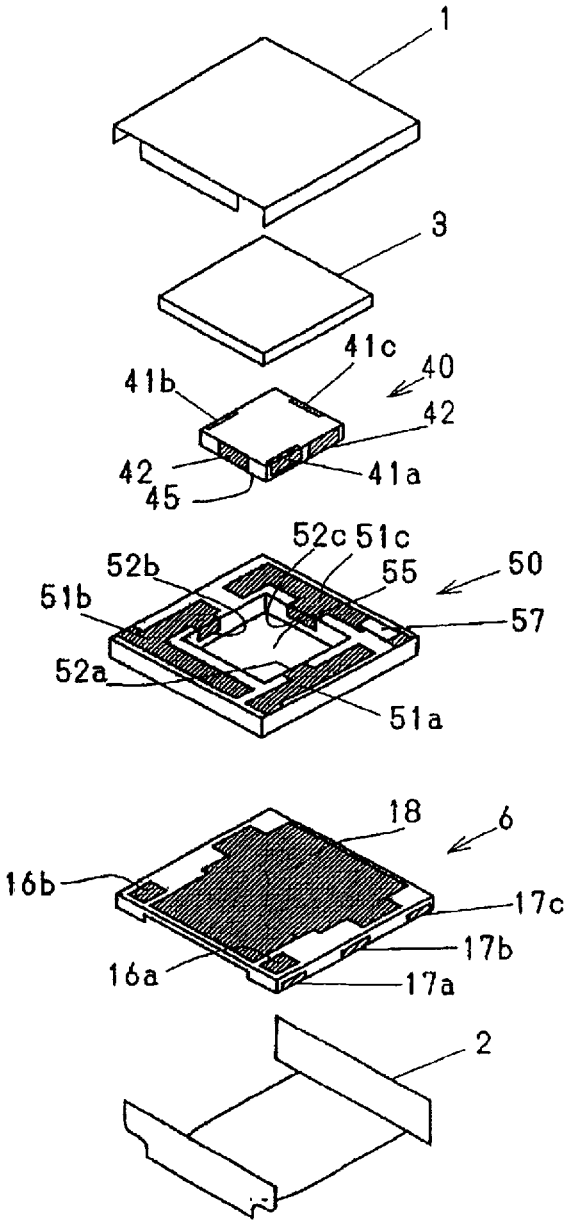
FIG. 9 is an exploded perspective view showing a non-reciprocal circuit device according to the second embodiment of the present invention.
Figure 10:
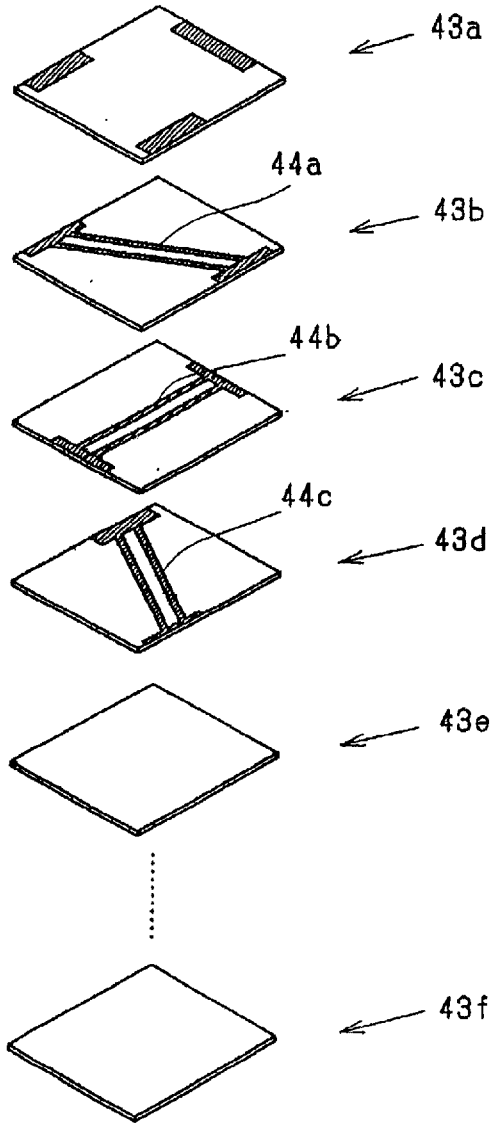
FIG. 10 is an exploded perspective view showing the structure of a central conductor assembly according to the second embodiment of the present invention.

FIG. 9 shows an isolator according to the second embodiment of the present invention. This isolator differs from that of the first embodiment in the structures of the laminated central conductor assembly 40 and the laminate module 50. The laminated central conductor assembly (central conductor laminate) 40 of this embodiment is formed by printing central conductor patterns 44*a*–44*c* onto magnetic ceramic green sheets 43*a*–43*f*, laminating and pressing these green sheets 43*a*–43*f* and sintering them. The magnetic ceramic green sheets are formed from garnet powder. Capacitor-connecting electrodes 41*a*–41*c* for connecting ends of central conductors 44*a*–44*c* to capacitor electrodes 51*a*–51*c* on the laminate module 50, a grounding electrode 45 provided on a lower surface of the central conductor laminate 40, and side-surface electrodes 42 for connecting the other ends of central conductors 44*a*–44*c* to the grounding electrode 45 may be formed on the central conductor laminate 40, by printing green sheets and burning the printed electrodes and the ceramic green sheets simultaneously, or by printing electrodes on sintered ceramic sheets and burning the electrodes. The grounding conductor 45 of the central conductor laminate 40 is placed on the ground electrode 18 of the resin-conductor composite base 6 and electrically connected by soldering. The electrodes 51*a*–51*c* of capacitors in the laminate module 50 of this embodiment are connected to input/output electrodes and a ground electrode (not shown) on a lower surface of the laminate module through via-electrodes provided in the laminate module 50.

When the central conductor laminate 40 is in a rectangular shape, the laminate module 50 is provided with a rectangular through-hole 55 corresponding to the central conductor laminate 40 substantially at a center thereof. Further, formed inside the through-hole 55 are internal electrodes 52*a*, 52*b*, 52*c* for connecting the capacitor electrodes 51*a*–51*c* to the capacitor-connecting electrodes 41*a*–41*c* of the central conductor laminate 40. The internal electrodes 52*a*–52*c* may be formed by simultaneous burning with ceramic or by printing sintered, laminated ceramic sheets and burning them. The capacitor-connecting electrodes 41*a*–41*c* may be soldered to the internal electrodes 52*a*–52*c* via so-called side through-holes. With the central conductor laminate 40 and the center through-hole 55 of the laminate module 50 having the same shape, the central conductor laminate 40 can easily be positioned and connected to the laminate module 50. Because the other parts such as a resin-conductor composite base, etc. may be the same as those in the first embodiment, their explanation will be omitted here.

(3) Third Embodiment

Figure 11A:
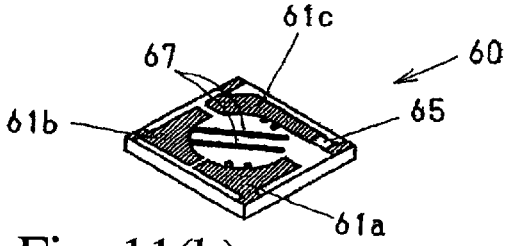
FIG. 11(*a*) is a cross-sectional view showing a laminate module according to the third embodiment of the present invention.
Figure 11B:
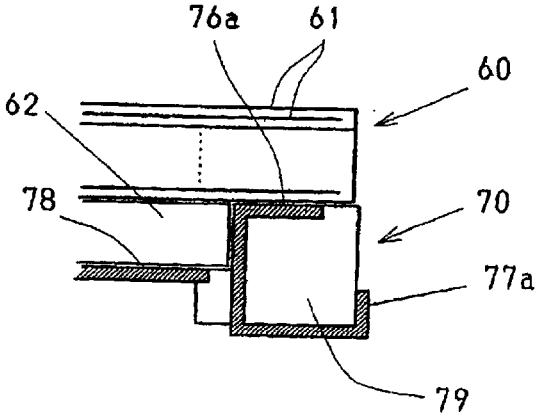

FIGS. 11(*a*)and(*b*) show an isolator according to the third embodiment of the present invention. While the central conductor laminate 40 comprising central conductors inside a magnetic body is combined with the laminate module 50 comprising capacitors therein in the second embodiment, the isolator according to the third embodiment comprises central conductors 67 formed on a surface and inside of a laminate module 60 as shown in FIG. 11(*a*), with a magnetic body 62 disposed between a resin-conductor composite base 70 and the laminate module 60 as shown in FIG. 11(*b*). In this case, by setting outer frames such as terminal electrodes 76*a* in an insulating thermoplastic resin portion 79 of the resin-conductor composite base 70 and a ground electrode (not shown) as high as the thickness of the magnetic body 62, an upper surface of the magnetic body 62 disposed on the resin-conductor composite base 70 is in the same plane as the upper surface of the resin-conductor composite base 70. Accordingly, the laminate module 60 having a flat lower surface can be disposed on the ground electrode 78 and the magnetic body 62.

(4) Fourth Embodiment

Figure 12:
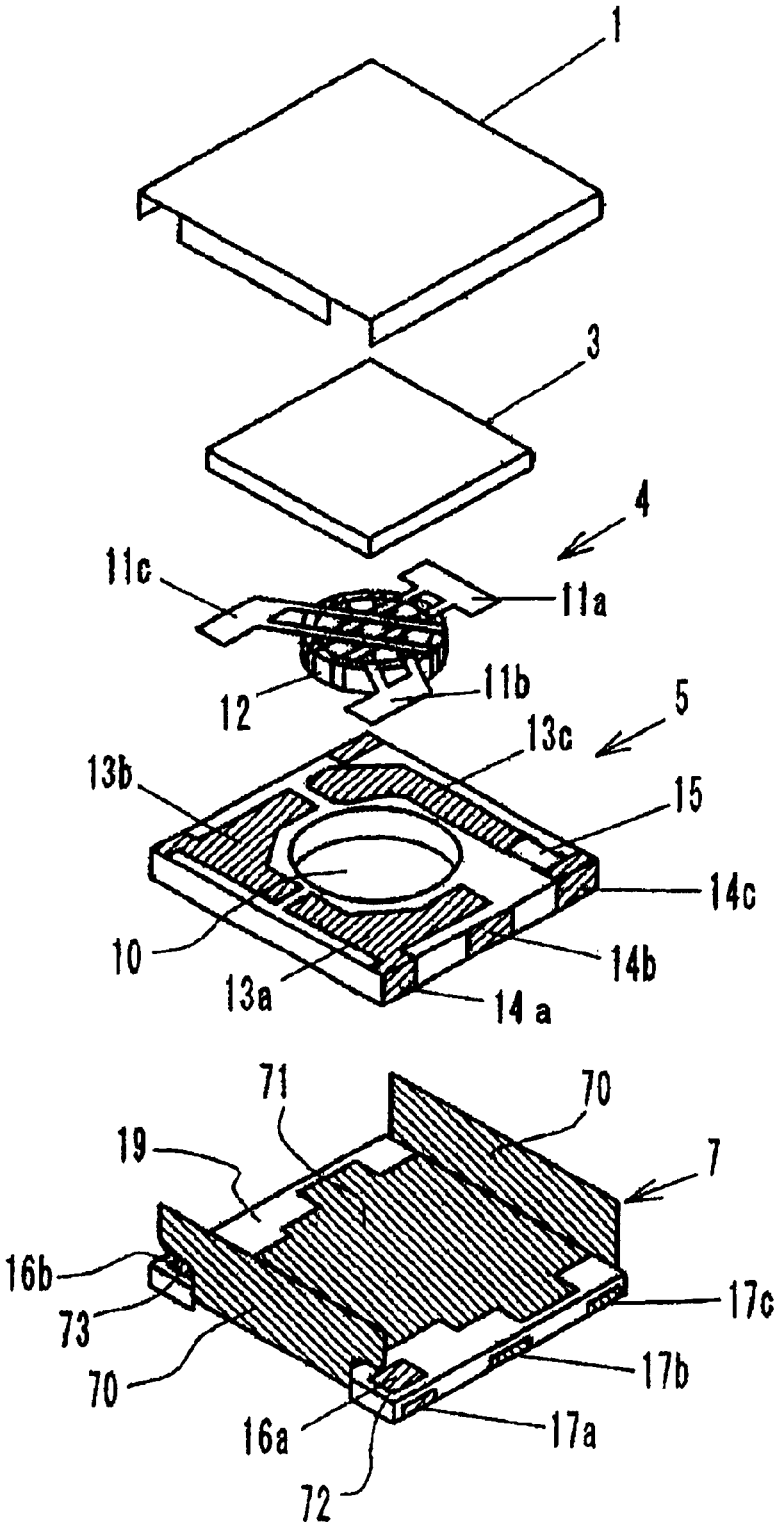
FIG. 12 is a perspective view showing a non-reciprocal circuit device comprising another resin-conductor composite base integrally constituted by the resin-conductor composite base of the fourth embodiment and a lower case.

FIG. 12 shows an isolator according to the fourth embodiment of the present invention. Because an upper case 1, a permanent magnet 3, a central conductor assembly 4, a laminate module 5 and external terminals in the fourth embodiment are the same as those in the first embodiment, the same reference numerals as in FIG. 1 are given to them in FIG. 12. In this embodiment, the same resin-conductor composite base 6 and the same lower case 2 as in the first embodiment are integrally molded together to provide a resin-conductor composite base 7. The resin-conductor composite base 7 is obtained by placing a conductor plate 71 punched and bent to have a portion constituting a ground electrode, portions constituting external terminals, and upright portions 70 of a lower case, a conductor plate 72 constituting a terminal electrode 16*a* and an input external terminal 17*a*, a conductor plate 73 constituting a terminal electrode 16*b* and an output external terminal 17*d* in a molding die such that these conductor plates are positioned on the same plane, and integrally injection-molding them with an insulating thermoplastic resin 19. Because two parts of the resin-conductor composite base and the lower case in the first embodiment are integrated into a single part as the resin-conductor composite base 7, the number of parts used is reduced, resulting in decrease in the number of assembling steps.

Because a magnetic circuit should be constituted, the lower case comprising a conductor plate 71 is preferably formed by a laminate of a metal having as high saturation magnetic flux density as 0.6 T (tesla) or more integrally clad with a high-conductivity metal having an electric resistance of $5.5\times10^{-8}$ Ω·m or less. More preferably, a metal material having as high saturation magnetic flux density as 2.0 T (tesla) or more, which is selected from iron-based metals (SPCC), 42 Ni—Fe alloys, Fe—Co alloys, etc., is integrally clad with a high-conductivity metal having an electric resistance of $5.5\times10^{-8}$ Ω·m or less such as copper, oxygen-free copper, brass, phosphor bronze, etc. For instance, a clad plate of an SPCC plate and a copper plate is used, with the copper plate on the side of a surface, on which the laminate module is disposed, for functioning as a conductor plate, and with the SPCC plate on the outside for functioning as a magnetic yoke, thereby achieving a magnetic circuit having high conductivity and low-loss.

In another example, a lower case (iron-based metal plate, etc.) and a conductor plate (copper plate, etc.) produced separately may be integrated by direct soldering, etc., and injection-molded with an insulating thermoplastic resin to provide a resin-conductor composite base integrally comprising a lower case.

(5) Fifth Embodiment

Figure 13:
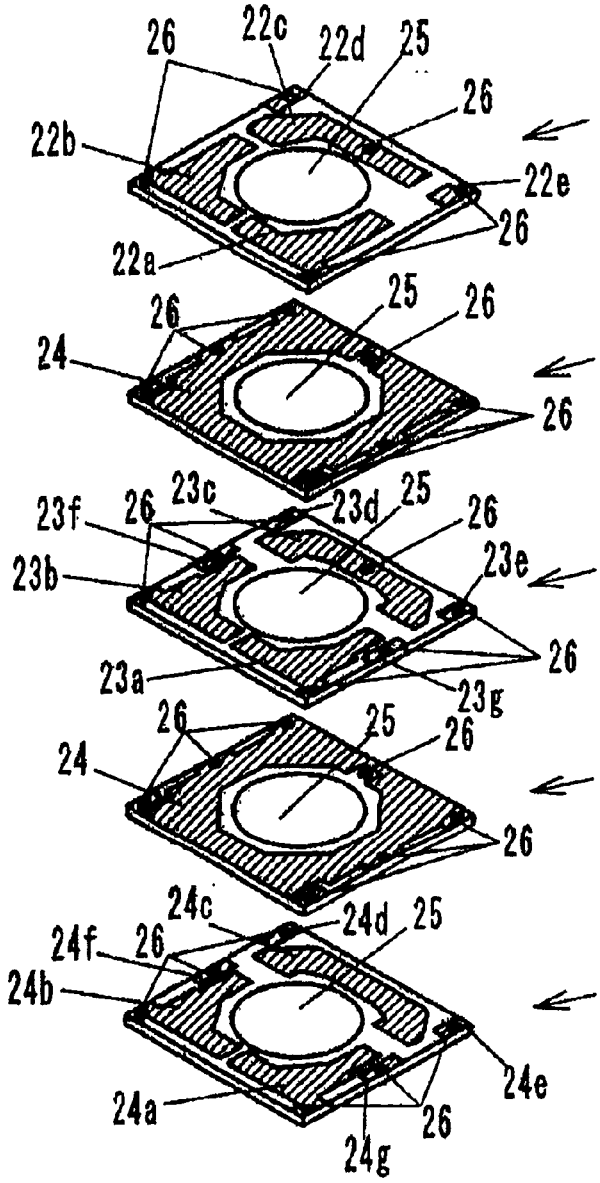
FIG. 13 is an exploded perspective view showing a laminate module according to the fifth embodiment of the present invention.

FIG. 13 shows a laminate module according to the fourth embodiment of the present invention. This embodiment is a modification of the laminate module shown in FIG. 2, with the same reference numerals given to the same constituents. While only a load electrode 22*c* is connected through a via-electrode 26 in the embodiment shown in FIG. 2, all of capacitor electrodes 22*a*–24*a* on the input side, capacitor electrodes 22*b*–24*b* on the output side, load electrodes 22*c*–24*c* and ground electrodes 22*d*–24*d*, 22*e*–24*e*, 23*f*, 24*f*, 23*g*, 24*g* are connected through via-electrodes 26 in this embodiment. This structure simplifies a production process and thus shortens tact, resulting in lower production cost, than when the side-surface electrodes are used. The connection of electrode patterns is carried out with via-electrodes, side-surface electrodes, side through-holes, etc., and these connection means may be selected properly, considering their characteristics.

[2] Wireless communications equipment

Figure 14:
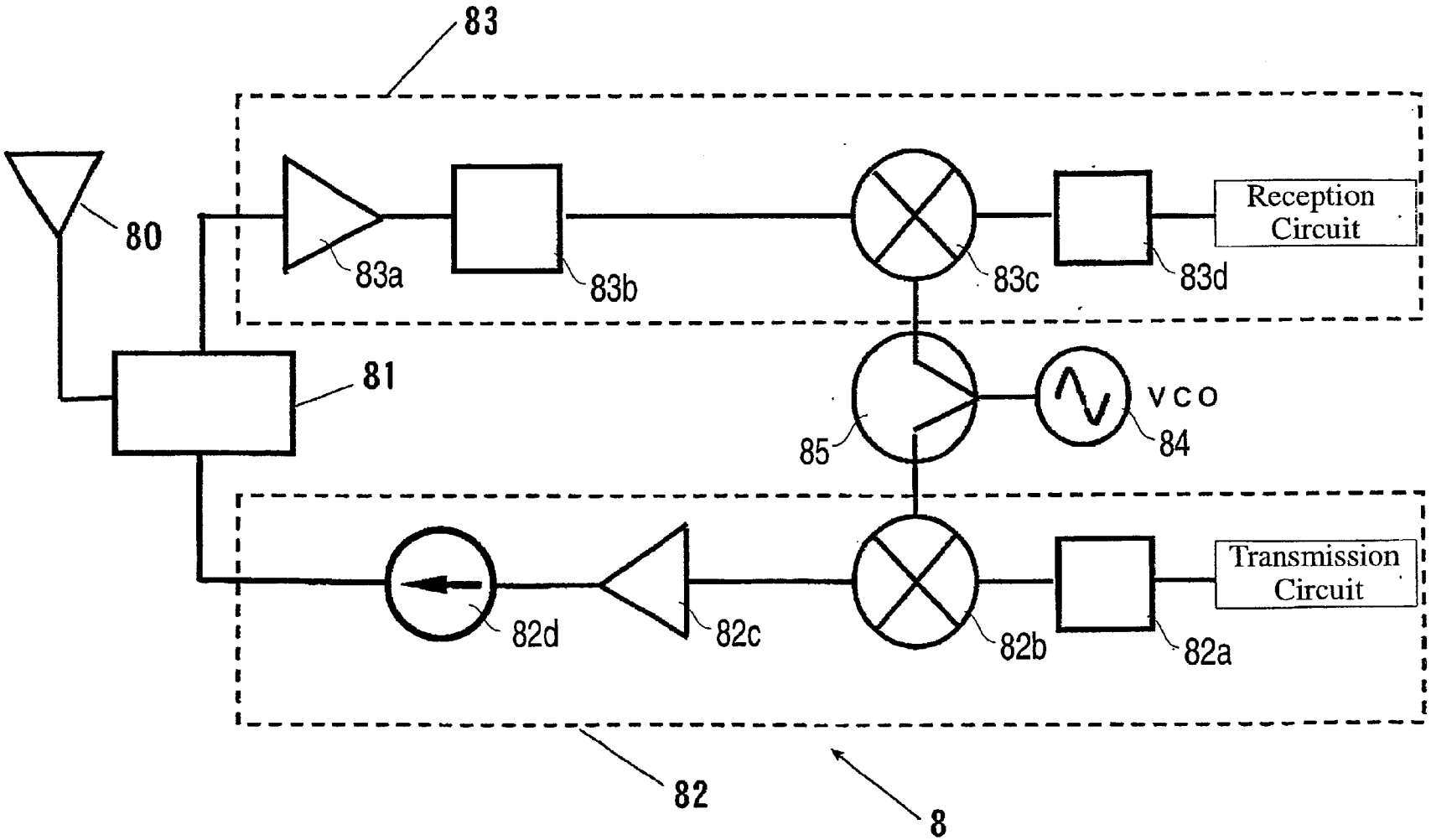
FIG. 14 is a block diagram showing one example of the wireless communications equipment of the present invention.
Figure 15:
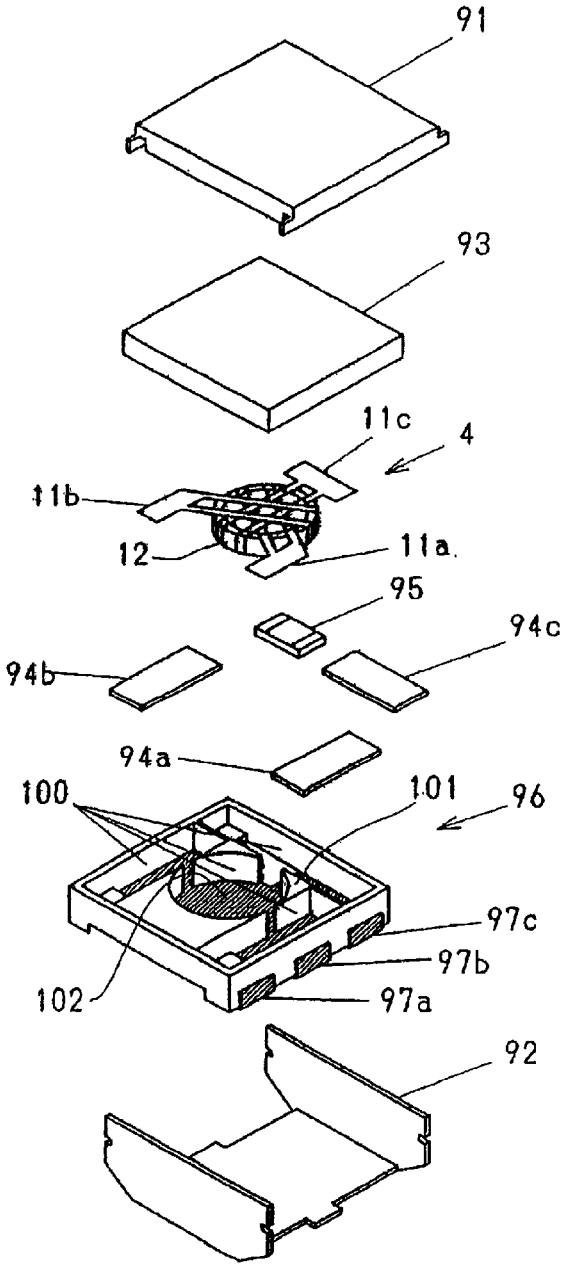
Fig. 15 PRIOR ART
FIG. 15 is an exploded perspective view showing one example of conventional non-reciprocal circuit devices.
Figure 16:
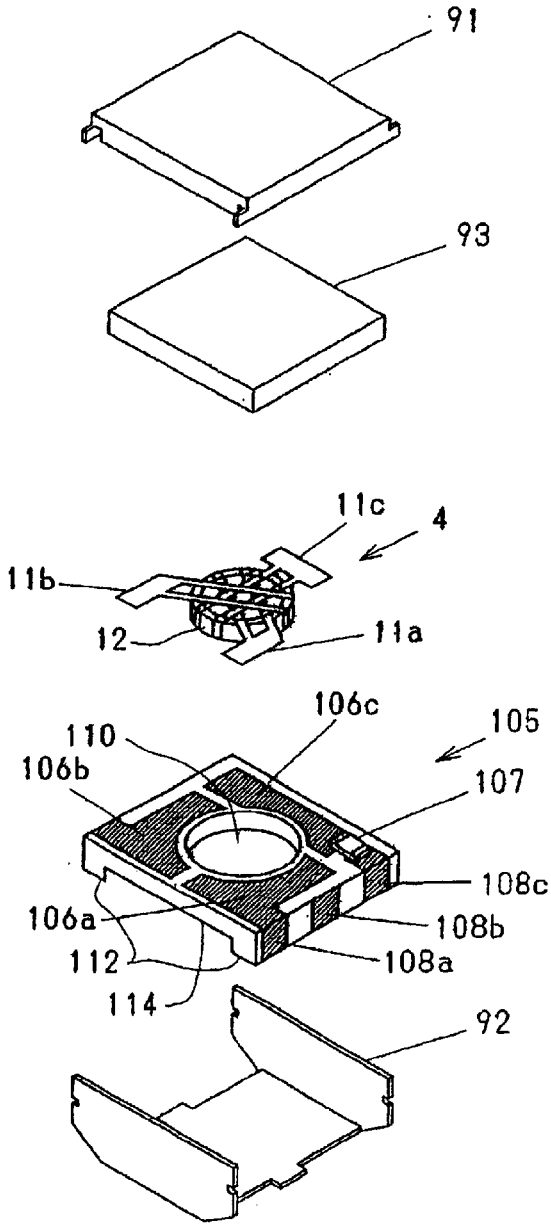
Fig. 16 PRIOR ART
FIG. 16 is an exploded perspective view showing another example of conventional non-reciprocal circuit devices.

FIG. 14 is a schematic block diagram showing a cellular phone as wireless communications equipment comprising the isolator of the present invention. The wireless communications equipment of this embodiment comprises an antenna 80, a duplexer 81 comprising a transmission filter and a reception filter, a transmission circuit 82 connected to an input/output means on the side of a transmission filter of the duplexer 81, and a reception circuit 83 connected to an input/output means on the side of a reception filter of the duplexer 81.

The transmission circuit 82 comprises a filter 82*a*, a mixer 82*b* and a power amplifier 82*c* in this order from the transmission circuit side. A transmission signal is amplified by the power amplifier 82*c* and passes through the isolator 82*d* of the present invention and the transmission filter of the duplexer 81, followed by emission from the antenna 80. A reception signal is transmitted from the antenna 80 to the reception filter of the duplexer 81 and then to the reception circuit 83, where it is amplified by a low-noise amplifier 83*a*. After it passes through a filter 83*b*, it is mixed with a signal emitted from a base station and distributed by a splitter 85 from a voltage-controlled oscillator VCO 84 by the mixer 83*c* to be converted to an intermediate frequency. The reception signal flowing from the mixer 83*c* enters into a reception circuit via a filter 83*d*.

The above structure is a mere example of the wireless communications equipment. In the wireless communications equipment comprising a non-reciprocal circuit device of the present invention such as a miniaturized isolator, the resin-conductor composite base has good flatness in a contact surface comprising external terminals, free from insufficient connection of the external terminals to the circuit board. Also, because there is no erosion by soldering, soldering operation is extremely easy and reliable. Further, the mounting of the non-reciprocal circuit device of the present invention necessitates only a small area of a circuit board, it can provide miniaturized, lightweight wireless communications equipment. Even when the wireless communications equipment such as a cellular phone drops, for instance, from a height of a human face to a floor, the isolator part does not suffer damage because of the resin-conductor composite base.

As described above, the non-reciprocal circuit device of the present invention is easily miniaturized because matching capacitors are formed in the laminate module. Also, because the non-reciprocal circuit device of the present invention comprises a resin-conductor composite base or resin-conductor composite base having terminal electrodes connected to the input/output terminals and ground terminals of a laminate module in the same plane as the ground electrode, and integrally having external terminals for connecting the internal circuit of the laminate module to the external circuit, it has a small size, low loss and high reliability, and is easy to produce. With this non-reciprocal circuit device, a miniaturized, high-performance wireless communications equipment can be obtained.

What is claimed is:

1. A non-reciprocal circuit device comprising a plurality of central conductors overlapping with electric insulation from each other at a predetermined angle, a magnetic body disposed in contact with or close to said central conductors, matching capacitors, a permanent magnet disposed for applying a DC magnetic field to said central conductors and said magnetic body, and metal cases for receiving these parts and serving as a magnetic yoke, wherein at least said matching capacitors are integrally constituted in a laminate module having a substantially flat lower surface, and said laminate module is disposed on a substantially flat surface of a composite base comprising an insulation member and conductor plates, said laminate module having a ground electrode for connecting said capacitors to a ground on a substantially entire lower surface thereof, said composite base comprising a ground electrode connected to said central conductors and said capacitors of said laminate module and terminal electrodes connected to said central conductors and said capacitors of said laminate module on the same plane, said ground terminals connected to said ground electrode and said input/output terminals connected to said terminal electrodes being provided as external terminals on side surfaces and/or a lower surface of said laminate module, wherein said ground electrode of said composite base and at least one ground terminal are integrally formed by the same conductor plate, wherein terminal electrodes and at least one input/output terminal are integrally formed by the same conductor plate, and said terminal electrodes are not electrically connected to each other within the same conductor plate, and wherein said ground electrode of said laminate module is disposed directly on a substantially entire upper surface of a ground electrode of said composite base.

2. The non-reciprocal circuit device according to claim 1, wherein said composite base is a resin-conductor composite base comprising conductor plates having an electric resistance of $5.5\times10^{-8}$ Ω·m or less integrally molded with an insulating thermoplastic resin.

3. The non-reciprocal circuit device according to claim 2, wherein a ground electrode and terminal electrodes of said resin-conductor composite base have contact surfaces in the same plane.

4. The non-reciprocal circuit device according to claim 2, wherein said resin-conductor composite base has a means for positioning said laminate module on a flat upper surface thereof, said means comprising external terminals on side surfaces of the resin-conductor composite base.

5. The non-reciprocal circuit device according to claim 1, wherein electrode patterns in said laminate module are connected through via-electrodes and/or side-surface electrodes.

6. The non-reciprocal circuit device according to claim 1, wherein said central conductors are formed in an integral central conductor laminate comprising a plurality of ceramic sheets having central conductor patterns.

7. The non-reciprocal circuit device according to claim 6, wherein said ceramic sheet is made of a magnetic ceramic for forming said central conductors.

8. The non-reciprocal circuit device according to claim 6, wherein said central conductor patterns in said central conductor laminate are connected through via-electrodes and/or side-surface electrodes.

9. The non-reciprocal circuit device according to claim 1, wherein said central conductors are bent along an outer surface of said magnetic body, and insulation films are disposed said central conductors in their crossing portions.

10. The non-reciprocal circuit device according to claim 1, wherein said central conductors and said magnetic body are formed by an integral laminate comprising a plurality of ceramic sheets having central conductor patterns.

11. The non-reciprocal circuit device according to claim 10, wherein said ceramic sheet is made of a magnetic ceramic.

12. The non-reciprocal circuit device according to claim 1, wherein at least a lower case of said metal cases is formed by an integral laminate of a metal having as high saturation magnetic flux density as 0.6 T or more clad with a high-conductivity metal having an electric resistance of $5.5\times10^{-8}$ Ω·m or less, whereby said lower case serves as an electrically conductive magnetic yoke.

13. A wireless communications equipment comprising a non-reciprocal circuit device of claim 1, a transmission circuit, a reception circuit, and an antenna.

14. The wireless communications equipment according to claim 13, wherein it is a cellular phone.

* * * * *